US008434467B2

(12) United States Patent
LoRocco

(10) Patent No.: US 8,434,467 B2
(45) Date of Patent: May 7, 2013

(54) DETACHABLE QUIVER ASSEMBLY FOR ARCHERY BOWS

(76) Inventor: Paul LoRocco, Dallas, TX (US)

( * ) Notice: Subject to any disclaimer, the term of this patent is extended or adjusted under 35 U.S.C. 154(b) by 456 days.

(21) Appl. No.: 12/475,893

(22) Filed: Jun. 1, 2009

(65) Prior Publication Data

US 2010/0300421 A1 Dec. 2, 2010

(51) Int. Cl.
*F41B 5/06* (2006.01)

(52) U.S. Cl.
USPC ..... 124/86

(58) Field of Classification Search ..... 124/86; 24/457, 458, 591.1
See application file for complete search history.

(56) References Cited

U.S. PATENT DOCUMENTS

| | | | | |
|---|---|---|---|---|
| 4,156,496 | A | 5/1979 | Stinson | |
| 4,195,616 | A | 4/1980 | Darlington | |
| 4,252,101 | A | 2/1981 | Spitzke | |
| 4,363,312 | A | 12/1982 | Spitzke | |
| 4,621,606 | A | 11/1986 | Toth | |
| 5,190,022 | A * | 3/1993 | Larson | 124/25.7 |
| 5,265,584 | A * | 11/1993 | Judson et al. | 124/86 |
| 5,265,585 | A | 11/1993 | Stinson | |
| 5,566,665 | A | 10/1996 | Stinson | |
| 6,450,338 | B1 * | 9/2002 | Chen | 206/378 |
| 6,637,605 | B2 * | 10/2003 | Ernst | 211/70.6 |
| 6,672,299 | B2 | 1/2004 | Proctor | |
| 6,845,765 | B1 | 1/2005 | Allshouse et al. | |
| 2006/0112945 | A1 * | 6/2006 | Rager | 124/86 |
| 2007/0079821 | A1 | 4/2007 | Walk et al. | |
| 2008/0023420 | A1 * | 1/2008 | Kao | 211/70.6 |
| 2008/0251059 | A1 | 10/2008 | McPherson | |
| 2008/0302346 | A1 * | 12/2008 | Notestine | 124/25.7 |

* cited by examiner

*Primary Examiner* — Gene Kim
*Assistant Examiner* — Amir Klayman
(74) *Attorney, Agent, or Firm* — Alvin R. Wirthlin

(57) ABSTRACT

A quiver assembly for detachable connection to an archery bow includes a mounting base connectable to an archery bow and a quiver releasably connectable to the mounting base. The mounting base includes a base portion and a first clip portion extending from the base portion. The quiver is adapted to hold at least one arrow and includes a rail with a first longitudinally extending edge that cooperates with the first clip portion during rotation of the rail with respect to the mounting base for releasably connecting the quiver to the mounting base.

20 Claims, 6 Drawing Sheets

DETACHABLE QUIVER ASSEMBLY FOR ARCHERY BOWS

BACKGROUND OF THE INVENTION

This invention relates to quivers for archery bows, and more particularly to a quiver assembly that is removably connectable to an archery bow.

During hunting or target shooting with an archery bow, it is convenient to have a quantity of arrows readily available to the archer for fast reload. Thus, open rack quivers have been used which are attached to the bow on the side opposite the sight window. During hunting, target practice, transportation and/or storage of the archery bow and its accessories, it is sometimes desirable to quickly remove and attach the quiver for various reasons. Many of these quivers are attached in such a way that it is necessary to unscrew or unbolt the mount to remove the quiver. This can be a difficult and time consuming process, especially when hand tools are required.

SUMMARY OF THE INVENTION

According to one aspect of the invention, a quiver assembly for detachable connection to an archery bow comprises a mounting base connectable to an archery bow and a quiver releasably connectable to the mounting base. The mounting base includes a base portion and a first clip portion extending from the base portion. The quiver is adapted to hold at least one arrow and includes a rail with a first longitudinally extending edge that cooperates with the first clip portion during rotation of the rail with respect to the mounting base for releasably connecting the quiver to the mounting base.

According to another aspect of the invention, a quiver assembly for detachable connection to an archery bow comprises a mounting base connectable to an archery bow and a quiver releasably connectable to the mounting base. The mounting base includes a first height adjustment mechanism and the quiver includes a rail having a second height adjustment mechanism. The second height adjustment mechanism has a plurality of discrete elements for selective engagement with the first height adjustment mechanism to adjust a position of the quiver with respect to the mounting base.

According to yet a further aspect of the invention, a quiver assembly for detachable connection to an archery bow comprises a mounting base connectable to an archery bow and a quiver releasably connectable to the mounting base. The mounting base includes a base portion; first and second clip portions extending from the mounting base at diagonally opposite ends thereof, each clip portion being hook-shaped and including a lever arm segment extending forwardly from the base portion and a curved arm segment extending laterally inwardly from the second lever arm segment; and a locating pin extending from the base portion between the first and second clip portions. The quiver includes a rail having an elongate wall with spaced first and second longitudinally extending edges; and a plurality of discrete openings spaced along a length of the rail. Each opening is adapted to receive the locating pin to thereby adjust a height of the quiver with respect to the mounting base. At least one shaft holder is associated with the rail for holding an arrow shaft. With this arrangement, the first and second clip portions snap-fit onto the first and second longitudinally extending edges, respectively, during rotation of the rail with respect to the mounting base about a central axis of the locating pin for releasably connecting the quiver to the mounting base.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 1:
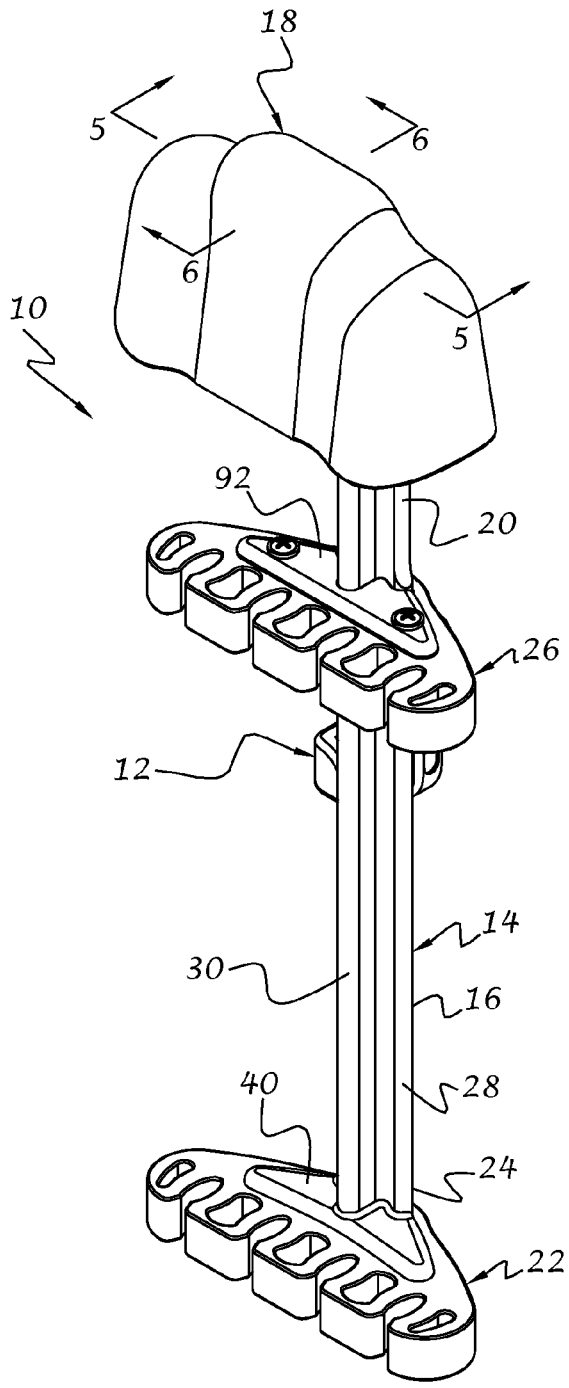
FIG. 1 is an upper front isometric view of a detachable quiver assembly for archery bows in accordance with the present invention.
Figure 2:
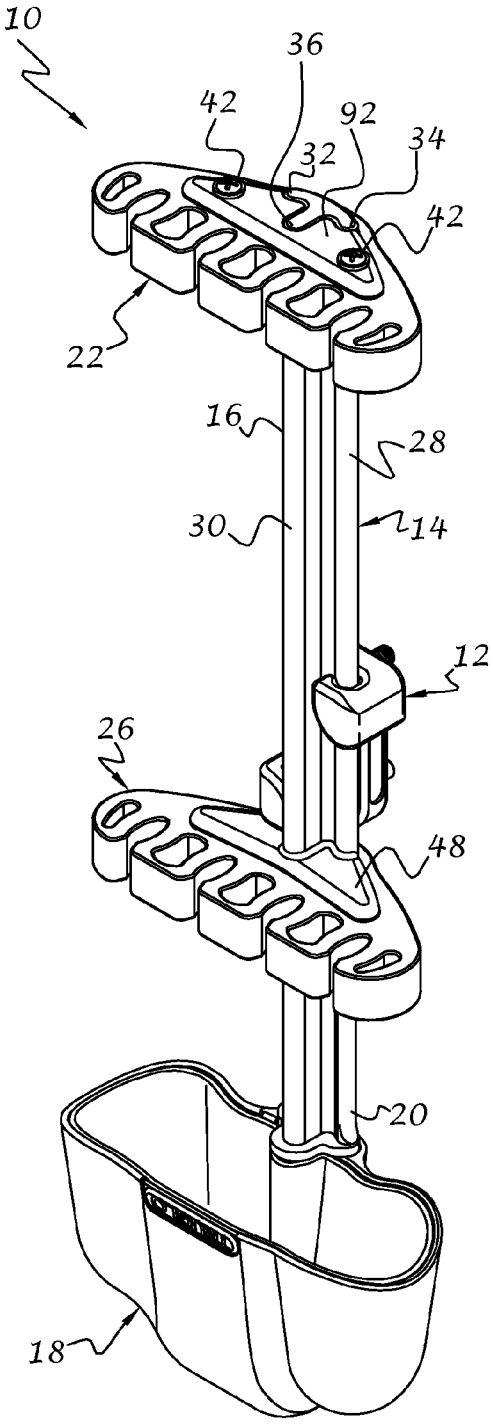
FIG. 2 is a lower front isometric view of the quiver assembly.

Referring now to the drawings, and to FIGS. 1 and 2 in particular, a detachable quiver assembly 10 in accordance with the present invention is shown. The quiver assembly 10 of the present invention can be adapted for use with any type of bow including, but not limited to, recurve bows, reflex bows, longbows, compound bows, crossbows, and so on.

The quiver assembly 10 preferably includes a mounting base 12 and a quiver 14 removably connected to the mounting base 12. The mounting base 12 is preferably secured to a bowsight mounting bracket 15, as schematically shown in phantom line in FIG. 3, which is in turn connected to the riser of a bow (not shown). However, it will be understood that the mounting base 12 can be connected to the riser or other part of the bow either directly or indirectly through one or more intermediate members.

Figure 3:
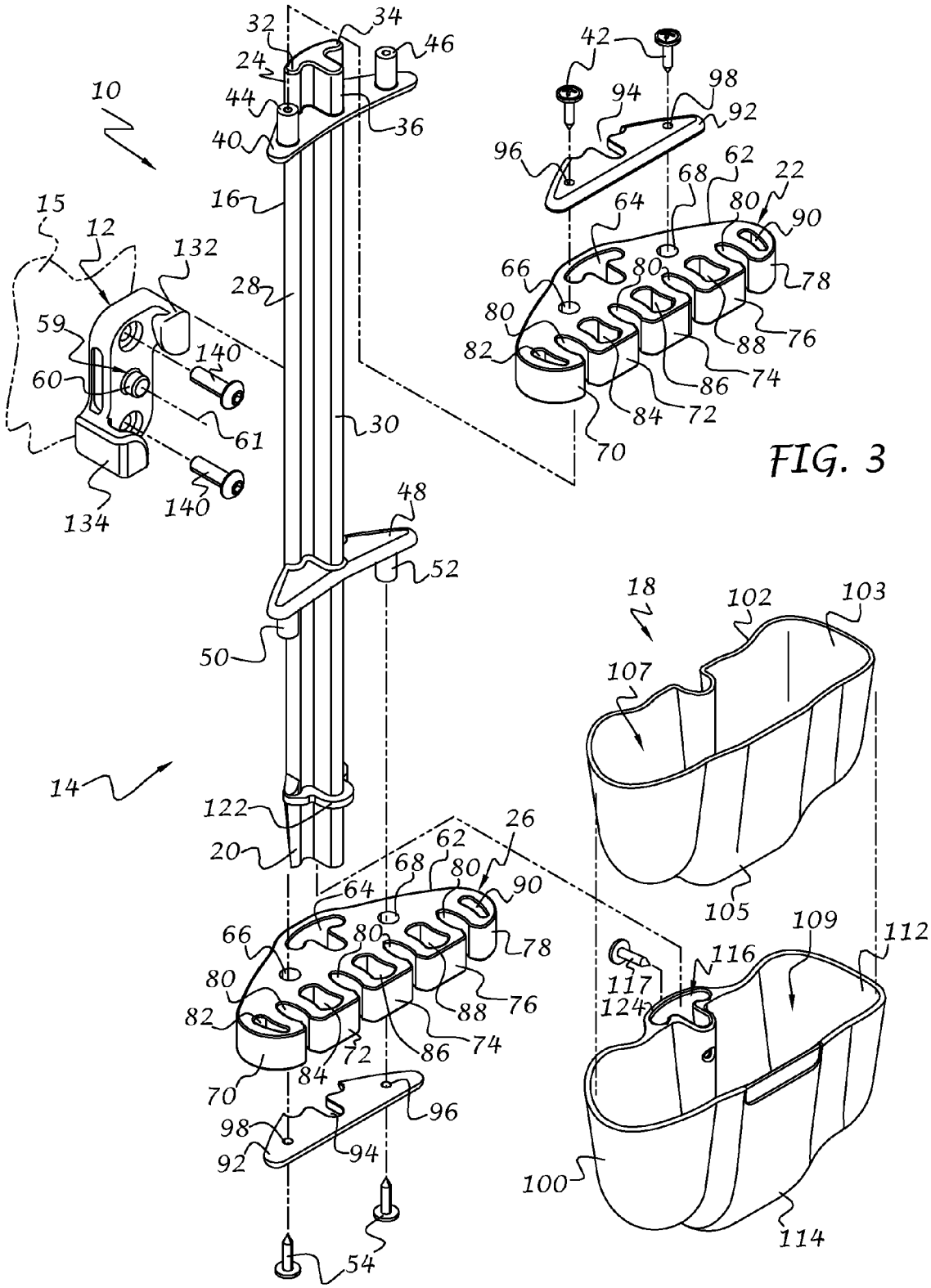
FIG. 3 is an exploded lower front isometric view of the quiver assembly.
Figure 4:
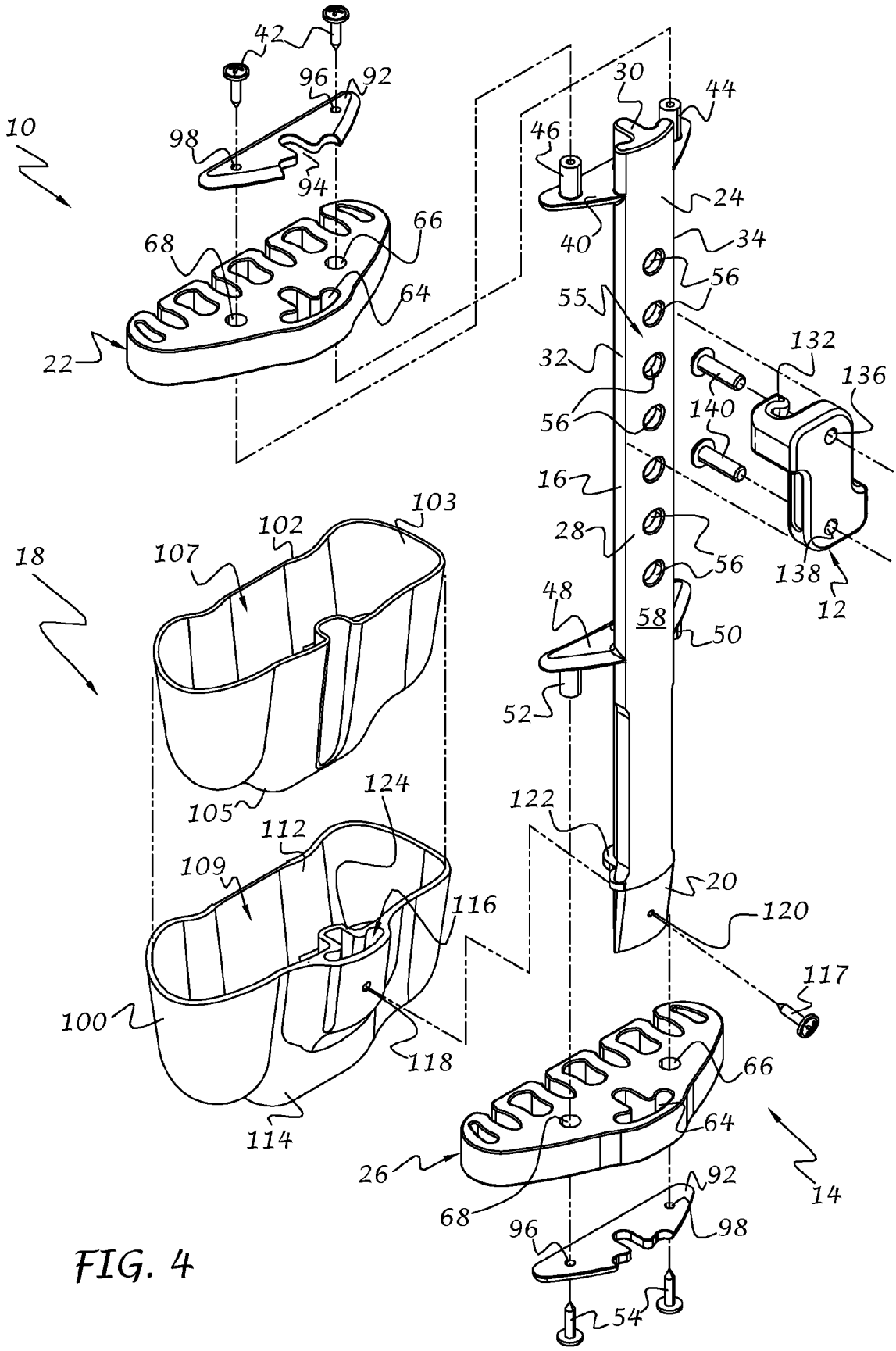
FIG. 4 is an exploded lower rear isometric view of the quiver assembly.
Figure 5:
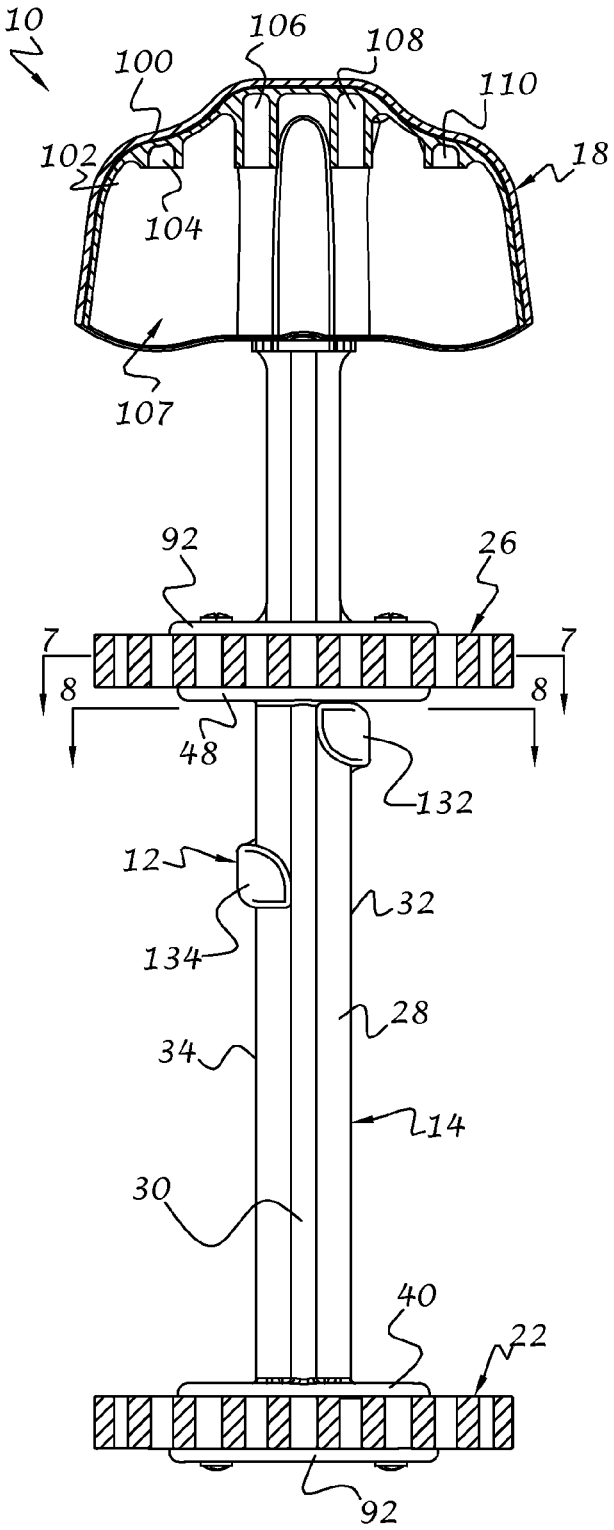
FIG. 5 is a sectional view of the quiver assembly taken along line 5-5 of FIG. 1.

With additional reference to FIGS. 3 and 4, the quiver 14 preferably includes an elongate rail 16, a hood 18 connected to an upper end 20 of the rail 16, a lower shaft holder 22 connected to a lower end 24 of the rail 16, and an upper shaft holder 26 connected to the rail 16 between the upper end 20 and lower end 24.

The elongate rail 16 is preferably generally T-shaped in cross section and includes an elongate wall 28 and a center rib 30 that extends forwardly from the wall. The wall 28 is preferably arcuate in shape along its length to create a snap-fit engagement with the mounting base 12 and the longitudinally extending edges 32, 34 of the first wall 28 are preferably curved to facilitate connection to the mounting base. The longitudinally extending outer free edge 36 of the rib 30 is also preferably curved.

A lower support plate 40 is preferably connected to the lower end 24 of the rail 16 for receiving the lower shaft holder 22. The support plate is generally triangular in shape and extends between the longitudinally extending edges 32, 34 and around the rib 30. A pair of spaced bosses 44 and 46 extend downwardly from the support plate 40. The bosses include bores for receiving threaded fasteners 42.

Likewise, an upper support plate 48 is preferably connected to the rail 16 between the upper end 20 and lower end 24 for receiving the upper shaft holder 26. The upper support plate 48 is also generally triangular in shape and extends between the longitudinally extending edges 32, 34 around the rib 30. A pair of spaced bosses 50 and 52 extend upwardly from the support plate 48. The bosses include bores for receiving threaded fasteners 54.

Preferably, the rail and the lower and upper support plates are integrally formed of a nylon-reinforced plastic material through injection molding. However, it will be understood that the rail and support plates can be formed separately of any suitable material and/or can be attached to together using well-known connection means such as welding, bonding, mechanical fastening, press-fitting, and so on.

Figure 6:
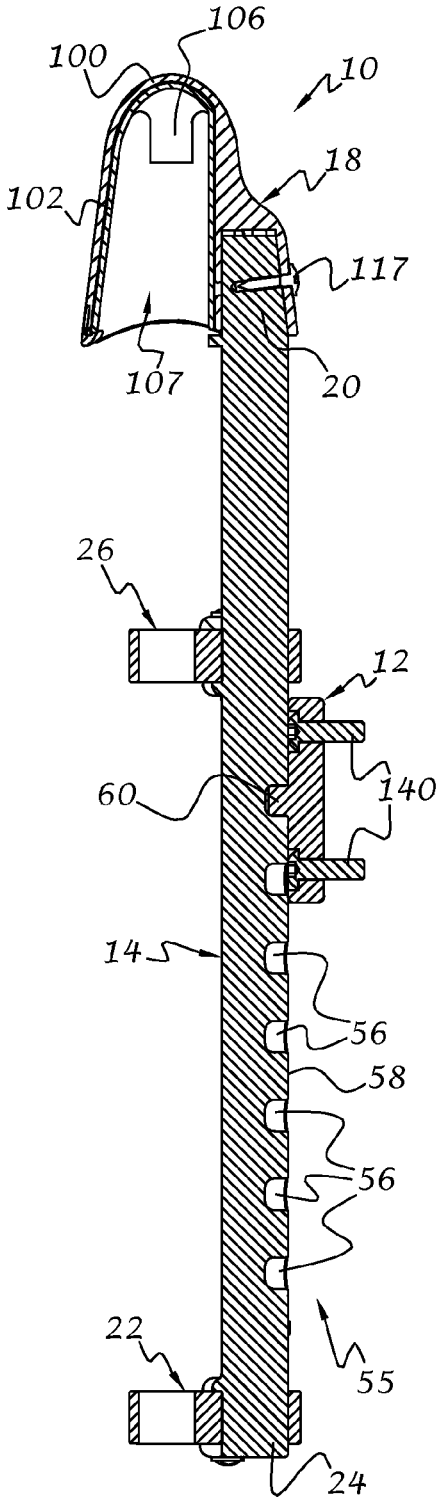
FIG. 6 is a sectional view of the quiver assembly taken along line 6-6 of FIG. 1.
Figure 7:
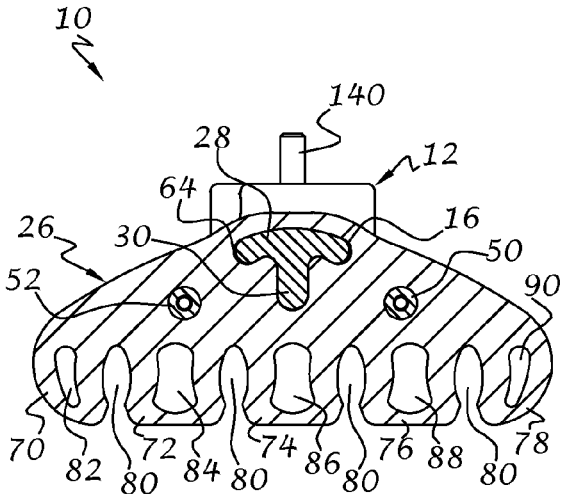
FIG. 7 is a sectional view of the quiver assembly taken along line 7-7 of FIG. 5.

As best shown in FIGS. 3, 4 and 6, a first height adjustment mechanism 55, preferably in the form of a plurality of discrete openings 56, are located on the rear surface 58 of the wall 28. The openings 56 are preferably formed as circular depressions that cooperate with a second height adjustment mechanism 59, preferably in the form of a complementary shaped locating pin 60, on the mounting base 12. The locating pin 60 together with the openings 56 provide discrete vertical positions of the quiver 14 with respect to the mounting base 12 as well as permitting relative rotation between the quiver 14 and mounting base about the pin axis 61 during installation and removal of the quiver with respect to the mounting base, as will be described in greater detail below. Although each opening 56 is shown as a depression formed in the wall 28, it will be understood that the openings can extend through the thickness of the wall without departing from the spirit and scope of the present invention. It will be further understood that the openings 56 on the rail 16 can be replaced with locating pins or other protrusions and the locating pin 60 on the mounting base 12 can be replaced with an opening or the like. In accordance with a further embodiment of the invention, the openings 56 and/or the pin 60 can be eliminated and replaced with an adjustment knob to tighten the mounting base 12 and quiver 14 against relative sliding movement.

Referring now to 3, 4, 7 and 8, the lower shaft holder 22 and upper shaft holder 26 are identical in construction and each preferably includes a generally triangular-shaped body 62 constructed of an elastomeric material. A generally T-shaped hole 64 extends through the body 62 adjacent to the apex of the triangular body for receiving the rail 16. A pair of openings 66 and 68 also extend through the body 62 on either side of the hole 64 for receiving the bosses 44 and 46 or 50 and 52, respectively, of one of the support plates 40, 48. Fingers 70, 72, 74, 76, and 78 are formed at the base of the triangular body 62 with a slot 80 extending between each finger. The slot 80 is adapted for receiving the shaft of an arrow (not shown) and frictionally holding the arrow on the quiver 14 when not in use. An opening 82, 84, 86, 88, and 90 is formed in each finger 70-78, respectively, so that the material surrounding each slot 80 can flex when the shaft of an arrow is inserted therein. It will be understood that upper and lower shaft holders of the present invention are not limited to the particular shape and material described, but may be constructed of any suitable material and shape. Moreover, although four slots 80 are shown for holding four arrow shafts, it will be understood that more or less slots can be provided.

The lower shaft holder 22 is installed on the rail 16 by aligning the hole 64 with the lower end 24 of the rail and the openings 66 and 68 with the bosses 44 and 46, respectively. The lower shaft holder 22 is then slipped over the lower end 24 of the rail 16 until it rests against the lower surface of the lower support plate 40. A generally triangular-shaped securing plate 92 with a depression 94 that complements the shape of the rail 16 is then installed on the lower shaft holder 22. The fasteners 42 are then slipped through spaced openings 96, 98 of the securing plate 92 and threaded into the bosses 44, 46 of the lower support plate 40. In this manner, the lower shaft holder 22 is securely sandwiched between the lower support plate 40 and the securing plate 92. The upper shaft holder 26 is installed over the upper support plate 48 in a similar manner.

As shown in FIGS. 3-6, the hood 18 preferably includes an outer housing 100 and an inner resilient boot 102. The inner boot 102 has a continuous side wall 103 and an upper wall 105 that forms a hollow interior 107. The side wall 103 and upper wall 105 preferably conform to a hollow interior 109 of the outer housing 100. The boot 102 preferably includes downwardly extending hollow protrusions 104, 106, 108 and 110 (FIG. 5) located in the hollow interior 107. The protrusions are in alignment with the slots 80 of the lower shaft holder 22 and upper shaft holder 26 to receive arrow tips or points (not shown) and isolate them from each other and the user. The boot 102 is preferably constructed of a resilient elastomeric material. However, it will be understood that the boot 102 can be constructed of any suitable material. It will be further understood that more or less hollow protrusions can be provided to accommodate more or less arrows.

The outer housing 100 has a continuous side wall 112 and an upper wall 114 that form the hollow interior 109 for receiving the boot 102. A generally T-shaped receptacle 116 is formed in the side wall 112 for receiving an upper end 20 of the rail 16. Preferably, the upper end 20 is tapered to conform to the shape of the receptacle 116. An aperture 118 (FIG. 4) is formed in the side wall 112 and intersects with the receptacle 116. A fastener 117 extends through the aperture 118 and threads into an opening 120 formed in the upper end 20 of the rail 16 to connect the hood 18 to the rail. A flange 122 is preferably formed at the upper end 20 of the rail 16 and abuts an upper edge 124 of the receptacle 116 to ensure proper positioning and alignment of the hood 18 during installation on the rail 16.

Figure 11:
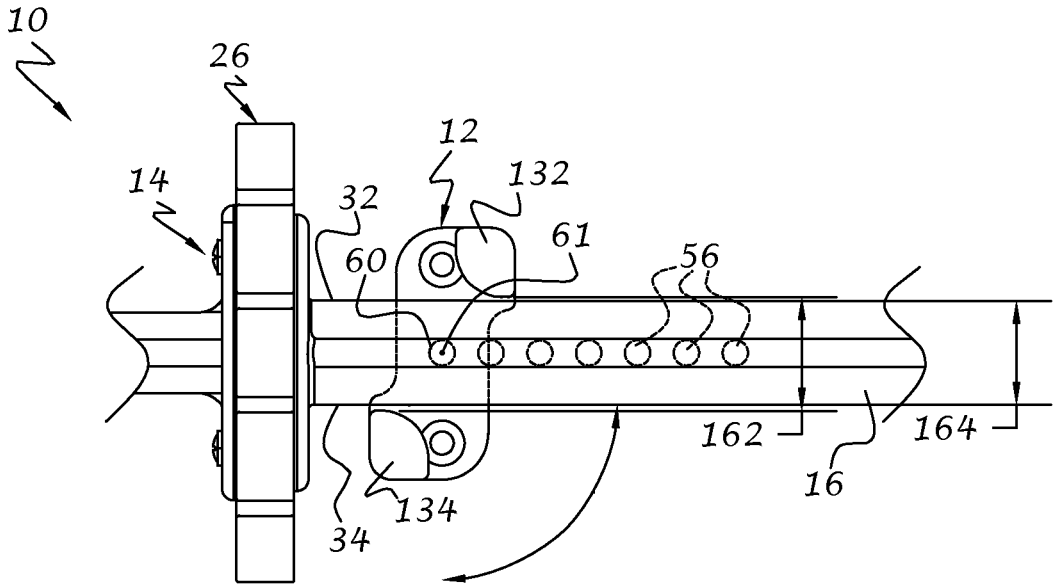
FIG. 11 is a front elevational view of a portion of the quiver assembly with the quiver in a connecting position for removal from or installation on the mounting base.
Figure 12:
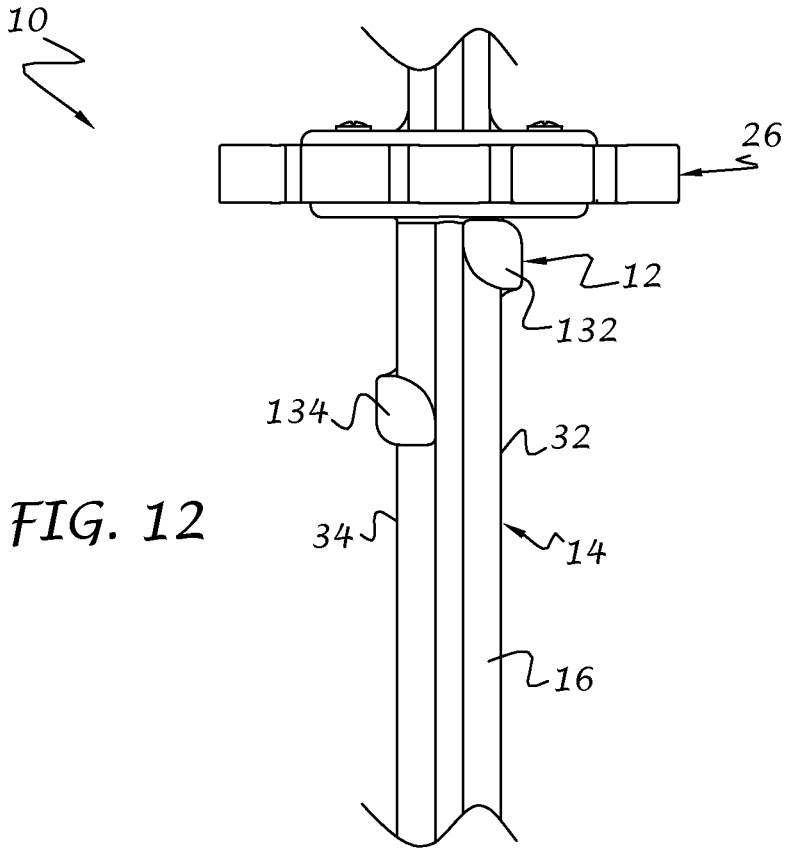
FIG. 12 is a front elevational view of a portion of the quiver assembly with the quiver rotated in the operational position.

Referring now to FIGS. 3, 4, 9 and 10, the mounting base 12 preferably includes a base portion 130 that is generally rectangular in shape with an upper or first clip portion 132 and a lower or second clip portion 134 that extend forwardly from the base portion. As shown, the first and second clip portions preferably extend from diagonally opposite ends or locations of the mounting base. It will be understood that the first and second clip portions need not be located at the corners but at any location that permits the rail 16 to fit therebetween in the connecting position, as shown in FIG. 11, before being rotated approximately 90 degrees about the central axis 61 of the pin 60, to the operational position, as shown in FIG. 12. A pair of countersunk apertures 136, 138 extend through the thickness of the base portion 130 and are sized to receive fasteners 140 to secure the mounting base 12 to a bowsight mounting bracket 15 (FIG. 3) or to the riser of a bow (not shown) or the like. The locating pin 60 is preferably mounted centrally between the apertures 136, 138 and extends forwardly from a front surface 142 of the base portion 130. It will be understood that the mounting base 12 is not limited to the generally rectangular shape but can be any shape such as circular, triangular, oblong, and so on, without departing from the spirit and scope of the invention.

The first clip portion 132 is preferably hook-shaped and includes a first lever arm segment 144 extending forwardly from a first longitudinal edge 145 of the base portion 130 and a first curved arm segment 146 extending laterally inwardly from the first lever arm segment. A gap 150 is formed between a tip 148 of the curved arm segment 146 and the front surface 142 of the base portion 130.

Likewise, the second clip portion 134 is preferably hook-shaped and includes a second lever arm segment 154 extending forwardly from a second longitudinal edge 155 of the base portion 130 and a second curved arm segment 156 extending laterally inwardly from the second lever arm segment. A gap 160 is formed between a tip 158 of the second curved arm segment 156 and the front surface 142 of the base portion 130.

The mounting base 12 is preferably constructed of a nylon reinforced plastic material or the like with sufficient resiliency so that the upper and lower lever arm segments can flex during installation and removal of the quiver 14. However, it will be understood that the mounting base 12 can be constructed of any suitable material.

Figure 8:
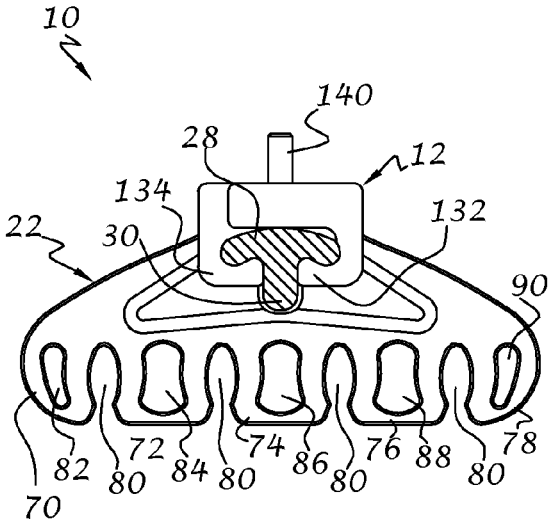
FIG. 8 is a sectional view of the quiver assembly taken along line 8-8 of FIG. 5.
Figure 9:
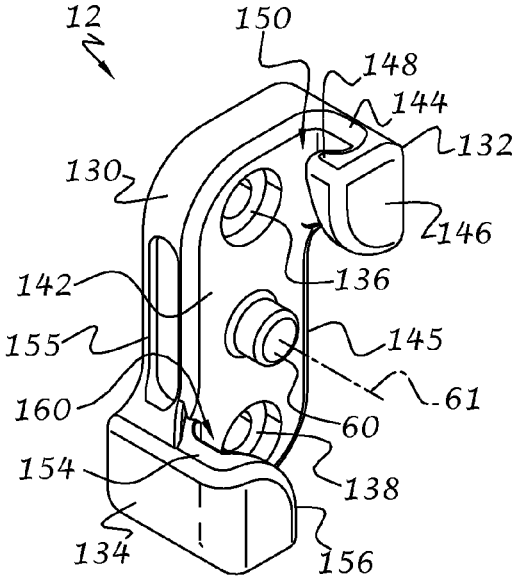
FIG. 9 is a front isometric view of a mounting base that forms part of the quiver assembly.
Figure 10:
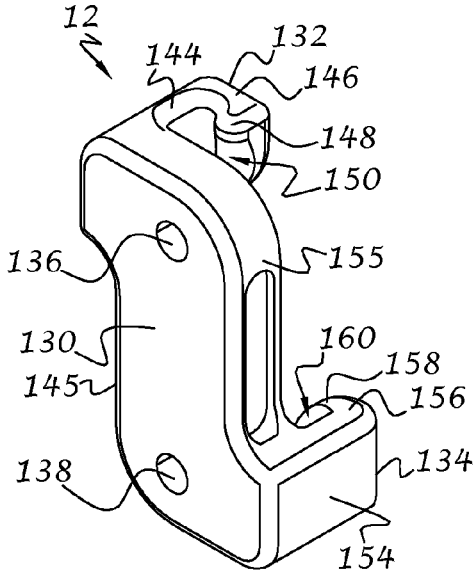
FIG. 10 is a rear isometric view of the mounting base.

Referring to FIGS. 8, 11 and 12, the quiver 14 is connected to the mounting base 12 by superposing the rail 16 over the mounting base in the connecting position, as shown in FIG. 11, and aligning the pin 60 with one of the openings 56. Preferably, a space 162 between the clip portions is greater than a width 164 of the rail so that the rail can be inserted between the clip portions in the connecting position. The pin 60 is then inserted into the selected opening 56 and the quiver 14 is rotated about a central axis 61 of the locating pin 60 in a clockwise direction, as viewed in FIG. 11, over an approximate angle of 90 degrees, until the first and second clip portions 132, 134 snap over the longitudinally extending edges 32 and 34, respectively, of the rail 16 to thereby lock the quiver 14 to the mounting base 12 in the operational position, as viewed in FIG. 12. As shown in FIG. 8, the curvature of the wall 28 creates bending forces in the base portion 140 to thereby ensure that the rail 16 is positively locked against movement to the mounting base 12, even when subjected to normal shock and vibration during use. To remove the quiver 14 from the mounting base 12, the quiver 14 is rotated about the central axis 61 of the locating pin 60 in a counter-clockwise direction, as viewed in FIG. 11, until the rail is again in the connecting position and the first and second clip portions 132, 134 are free of the longitudinally extending edges 32, 34, respectively, of the rail 16. The quiver can then be pulled away from the mounting base. In this manner, the quiver 12 may be easily installed on and removed from the bow without the use of hand tools. When the rail 16 is grasped by the user toward its upper or lower ends 20 or 24, a great amount of torque can be developed at the clip portions to further facilitate installation and removal of the quiver 14 with respect to the mounting base 12. In this manner, the clip portions 132, 134 can be constructed of a relatively stiff material to securely hold the quiver to the mounting base.

It will be understood that the term "preferably" as used throughout the specification refers to one or more exemplary embodiments of the invention and therefore is not to be interpreted in any limiting sense. It will be further understood that the term "connect" and its derivatives refers to two parts capable of being attached together either directly or indirectly through one or more intermediate members. In addition, terms of orientation and/or position as may be used throughout the specification denote relative, rather than absolute orientations and/or positions.

It will be appreciated by those skilled in the art that changes could be made to the embodiments described above without departing from the broad inventive concept thereof. By way of example, and in accordance with a further embodiment of the invention, instead of being curved, the wall 28 can be flat and the longitudinally extending edges 32, 34 can be teardrop or lobular in shape such that the gap 150, 160 of the clip portions between the tip of the curved arm segment and the front surface of the base portion 130 is narrower than a cross dimension of the longitudinally extending edges 32, 34. In this manner, the clip portions can be snap-fit onto the rail 16. Moreover, in each of the above embodiments, one of the longitudinally extending edges and/or one of the clip portions can be eliminated without departing from the spirit and scope of the claimed invention. It will be understood, therefore, that the present invention is not limited to the particular embodiments disclosed, but also covers modifications within the spirit and scope of the invention as defined by the appended claims.

What is claimed is:

1. A quiver assembly for detachable connection to an archery bow, the quiver assembly comprising:

a mounting base connectable to an archery bow, the mounting base including a base portion and a first clip portion extending from the base portion; and a quiver releasably connectable to the mounting base, the quiver being adapted to hold at least one arrow and including a rail with a first longitudinally extending edge;

wherein the clip portion is hook-shaped and includes a first arm segment extending forwardly from and transverse to the base portion and a second arm segment extending laterally inwardly from and transverse to the first arm segment, the first and second arm segments extending around and gripping the first longitudinally extending edge of the rail;

a locating pin extending from one of the base portion and the rail;

at lease one opening associated with the other of the base portion and the rail, the at least one opening rotatably engaging the locating pin such that the rail rotates with respect to the mounting base in opposing first and second directions about the locating pin;

whereby rotation of the rail in the first direction causes the first clip portion to extend around and grip the first longitudinally extending edge to thereby attach the quiver to the mounting base, and rotation of the rail in the opposing second direction causes the first clip portion to disengage from the first longitudinally extending edge to thereby detach the quiver from the mounting base.

2. A quiver assembly according to claim 1, wherein:

the mounting base includes a second clip portion extending from the base portion, the first and second clip portions having a width shorter than a length of the mounting base to thereby form a longitudinal space therebetween, the first and second clip portions being located at diagonally opposite ends of the mounting base such that the first clip portion opposes but does not directly face the second clip portion; and the rail includes a second longitudinally extending edge spaced from the first longitudinally extending edge;

whereby rotation of the rail in the first direction causes the second clip portion to extend around and grip the second longitudinally extending edge to thereby attach the quiver to the mounting base, and rotation of the rail in the opposing second direction causes the second clip portion to disengage from the second longitudinally extending edge to thereby detach the quiver from the mounting base.

3. A quiver assembly according to claim 2, wherein a the longitudinal space between the clip portions is greater than a lateral width of the rail so that the rail can be inserted between the clip portions in a connecting position wherein the longitudinally extending edges of the rail are oriented at a first angle with respect to the mounting base and rotated toward an operational position at a second angle with respect to the mounting base wherein the first and second clip portions snap over the first and second edges, respectively.

4. A quiver assembly according to claim 1, wherein the rail includes an elongate wall that is arcuate in shape along its length to create a bending force in the base portion when the clip portions engage the longitudinally extending edges of the rail to thereby securely hold the quiver to the mounting base.

5. A quiver assembly according to claim 4, and further comprising:

a first height adjustment mechanism associated with the base portion; and a second height adjustment mechanism associated with the rail;

the second height adjustment mechanism having a plurality of discrete elements for selective engagement with the first height adjustment mechanism to adjust a position of the quiver with respect to the mounting base.

6. A quiver assembly according to claim 5, wherein the first and second height adjustment mechanisms are mutually rotatable when engaged to thereby permit rotational engagement and disengagement of the clip portion with the rail about the locating pin in the first and second rotational directions.

7. A quiver assembly according to claim 6, wherein the first height adjustment mechanism comprises the locating pin extending from the base portion and the elements of the second height adjustment mechanism comprise a plurality of discrete openings spaced along a length of the rail.

8. A quiver assembly according to claim 1, and further comprising:

a first height adjustment mechanism associated with the base portion; and a second height adjustment mechanism associated with the rail;

the second height adjustment mechanism having a plurality of discrete elements for selective engagement with the first height adjustment mechanism to adjust a position of the quiver with respect to the mounting base.

9. A quiver assembly according to claim 8, wherein the first and second height adjustment mechanisms are mutually rotatable when engaged to thereby permit rotational engagement and disengagement in the first and second rotational directions of the first clip portion with the rail about the locating pin.

10. A quiver assembly according to claim 9, wherein the first height adjustment mechanism comprises the locating pin extending from the base portion and the elements of the second height adjustment mechanism comprise a plurality of discrete openings spaced along a length of the rail.

11. A quiver assembly according to claim 1, and further comprising at least one shaft holder associated with the rail for holding an arrow shaft.

12. A quiver assembly for detachable connection to an archery bow, the quiver assembly comprising:

a mounting base connectable to an archery bow, the mounting base including:

a base portion;

first and second clip portions extending from the mounting base at diagonally opposite ends thereof, each clip portion being hook-shaped and including a first arm segment extending forwardly from the base portion and a second arm segment extending laterally inwardly from the first arm segment; and a locating pin extending from the base portion between the first and second clip portions; and a quiver releasably connectable to the mounting base, the quiver including:

a rail having an elongate wall with spaced first and second longitudinally extending edges;

a plurality of discrete openings spaced along a length of the rail; each opening receiving the locating pin to thereby adjust a height of the quiver at discrete positions corresponding to the number of discrete openings with respect to the mounting base; and at least one shaft holder associated with the rail for holding an arrow shaft;

wherein the first and second clip portions extend around and snap-fit onto the first and second longitudinally extending edges, respectively, during rotation of the rail with respect to the mounting base about a central axis of the locating pin for releasably connecting the quiver to the mounting base.

13. A quiver assembly for detachable connection to an archery bow, the quiver assembly comprising:

a quiver adapted to hold at least one arrow and including a rail with first and second longitudinally extending edges;

a mounting base connectable to an archery bow and releasably connectable to the quiver, the mounting base comprising:

a base portion being generally rectangular in shape with first, second, third and fourth corner regions;

a first clip portion extending forwardly from the first corner region and toward a longitudinal centerline of the base portion;

a second clip portion extending forwardly from the third corner region of the base portion diagonally opposite the first clip portion and extending toward the longitudinal centerline of the base portion, the first and second clip portions being longitudinally spaced from the second and fourth corner regions, respectively;

a longitudinal space located between the first and second clip portions so that the first and second clip portions do not directly face each other, the longitudinal space being sized to receive the rail in a connecting position wherein the longitudinally extending edges of the rail are oriented at a first angle with respect to the mounting base and rotated toward an operational position at a second angle with respect to the mounting base such that the first and second clip portions snap over the first and second edges, respectively, of the rail.

14. A quiver assembly according to claim 13, and further comprising:

a locating pin extending from the base portion between the first and second clip portions; and at least one opening in the rail for rotatably receiving the locating pin;

whereby the first and second clip portions extend around and snap-fit onto the first and second longitudinally extending edges, respectively, during rotation of the rail with respect to the mounting base about the locating pin for releasably connecting the quiver to the mounting base.

15. A quiver assembly according to claim 14, and further comprising:

a plurality of discrete openings spaced along a length of the rail;

whereby the locating pin is received in a selected one of the openings to thereby adjust a position of the quiver with respect to the mounting base.

16. A quiver assembly according to claim 14, and further comprising at least one shaft holder associated with the rail for holding an arrow shaft.

17. A quiver assembly according to claim 14, wherein the rail includes an elongate wall that is arcuate in shape along its length to create a bending force in the base portion when the clip portions engage the longitudinally extending edges of the rail to thereby securely hold the quiver to the mounting base.

18. A quiver assembly according to claim 14, wherein each clip portion is hook-shaped and includes a first arm segment extending forwardly from and transverse to the base portion and a second arm segment extending laterally inwardly from and transverse to the first arm segment, the first and second arm segments extending around and gripping one of the longitudinally extending edges of the rail.

19. A quiver assembly according to claim 14, wherein the locating pin extends perpendicularly from the base portion.

20. A quiver assembly according to claim 1, wherein the locating pin extends perpendicularly from the base portion.

* * * * *

UNITED STATES PATENT AND TRADEMARK OFFICE
Certificate

Patent No. 8,434,467 B2

Patented: May 7, 2013

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Paul LoRocco, Dallas, TX (US); and John Estridge, Plano, TX (US).

Signed and Sealed this Third Day of June 2014.

GENE KIM
*Supervisory Patent Examiner*
Art Unit 3711
Technology Center 3700